US007913865B2

(12) United States Patent
Kontetzki

(10) Patent No.: US 7,913,865 B2
(45) Date of Patent: Mar. 29, 2011

(54) SUPPORT DEVICE

(75) Inventor: Arthur Kontetzki, Salzgitter (DE)

(73) Assignee: Voith Patent GmbH, Heidenheim (DE)

( * ) Notice: Subject to any disclaimer, the term of this patent is extended or adjusted under 35 U.S.C. 154(b) by 320 days.

(21) Appl. No.: 12/081,292

(22) Filed: Apr. 14, 2008

(65) Prior Publication Data

US 2009/0212000 A1 Aug. 27, 2009

(30) Foreign Application Priority Data

Feb. 25, 2008 (EP) ..... 08101964

(51) Int. Cl.
*B61G 7/00* (2006.01)

(52) U.S. Cl. ..... 213/61; 213/12; 213/50; 213/62 A; 213/69; 213/72

(58) Field of Classification Search ..... 213/74, 213/12, 13, 14, 18, 19, 20, 21, 50, 61, 62 A, 213/69, 64, 60, 71, 72
See application file for complete search history.

(56) References Cited

U.S. PATENT DOCUMENTS 3,378,150 A 4/1968 Cordani
3,417,876 A 12/1968 Stretch et al.
3,538,785 A * 11/1970 Grancon ..... 74/492
4,064,998 A 12/1977 Dilg et al.

* cited by examiner

*Primary Examiner* — Mark T Le
(74) *Attorney, Agent, or Firm* — Jean C. Edwards, Esq.; Akerman Senterfitt LLP

(57) ABSTRACT

A supporting device is provided to vertically support a coupling rod of a coupling pivotably articulated in the vertical direction to a car body underframe by a bearing block. The supporting device makes contact with the coupling rod by a support, wherein the supporting device includes a mount connected to the support which is fixed to the car body underframe of the vehicle. In order to enable the interference-free retraction of the central buffer coupling toward the car body in the event of a crash, the mount includes a connecting element by which the support is connected to the mount and which defines a rotational axis about which the support can rotate relative the connecting element. Further, at least one shearing element is provided which connects the connecting element to the support and which is designed to shear off upon the exceeding of a predetermined or definable amount of torque being transmitted from the support to the connecting element via the at least one shearing element in order to allow a rotation of the support relative the connecting element.

29 Claims, 4 Drawing Sheets

PRIOR ART

SUPPORT DEVICE

CROSS-REFERENCE TO RELATED APPLICATIONS

The present invention claims priority from European Patent Application No. 08 101 964.8 filed Feb. 25, 2008, the contents of which are herein incorporated by reference in their entirety.

BACKGROUND OF THE INVENTION

1. Field of the Invention

The present invention relates to a supporting device to vertically support a coupling rod of a central buffer coupling pivotably articulated vertically to a car body underframe of a vehicle by a bearing block, wherein the supporting device includes a support, able to be brought into contact with the coupling rod and a mount connected to the support which can be fixed to the car body underframe. The invention furthermore relates to the use of a supporting device in a railborne vehicle, in particular a rail vehicle.

2. Description of the Related Art

A supporting device of the above type is technically already known from the prior art, and in particular from rail vehicle technology. Such a supporting device serves to vertically support a coupling rod pivotably articulated vertically to a car body underframe.

FIG. 7 schematically depicts a partly sectional side view of a known per se central buffer coupling of AAR standard F (AAR=Association of American Railroads). The central buffer coupling 56 shown in FIG. 7 is particularly suited to connecting car bodies of a railborne vehicle, in particular rail vehicles, and includes thereto a coupling rod 50 with a coupling head 54 arranged at its coupling plane side end. As coupling head 54, the central buffer coupling 56 depicted in FIG. 7 specifically includes a coupling head of F classification in accordance with the AAR standard.

As can be gathered from FIG. 7, the coupling rod 50 is pivotably articulated via a bearing block 51 to the car body underframe 55 of the not explicitly shown, car body, in the vertical direction V and in the horizontal direction. In this way, the coupling rod 50 can follow the horizontal pivoting motion of coupling head 54 as well as vertical deflections, for example, to compensate for differences in height between the two coupling heads to be coupled together. The articulating of the coupling rod 50 ensues by an elastomer bearing configured in bearing block 51 in which elastomer spring elements 52 are provided, serving to cushion the tractive and impact forces transmitted from the coupling rod 50 in normal vehicle operation. Typically, the elastomer bearing configured in bearing block 51 is capable of allowing the coupling rod 50 the routinely required pivoting angle of approximately ±6° vertically and approximately ±15° horizontally.

The bearing block 51 is connected to a car body underframe 55 housing by a pivot pin 53. The housing of the car body underframe 55 also encloses a large part of the bearing block side section of coupling rod 50.

A supporting device 101 is provided in order to enable the appropriate vertical support for the coupling rod 50, articulated to pivot, vertically and otherwise. This type of vertical support is particularly necessary in order to enable trouble-free coupling of two central buffer couplings. In so doing, it needs to be ensured that the coupling rod 50 is always in the horizontal central longitudinal plane during the coupling procedure.

In the central buffer coupling 56 depicted schematically in FIG. 7, the supporting device 101 includes a support 102 configured as a support plunger which makes contact with the coupling rod 50. The supporting device 101, which is known per se, furthermore includes a mount 103. The supporting device 101 is an elastically-designed support in which the support plunger 102 is connected to the mount 103 by a spring element 104 and presses against the coupling rod 50 at a certain pretensioning as a result of the spring element 104. The pretensioning at which the support plunger 102 presses against the coupling rod 50 is adjustable by appropriately selecting the spring constant for the spring element 104 and should be selected such that in a non-operative state of the central buffer coupling 56; i.e., when no dynamic forces are being transmitted through the coupling rod 50 in the vertical direction V, the coupling rod 50 is in the horizontal central position.

The mount 103 of the supporting device 101, which on the one hand serves to hold the spring element 104 and the support plunger 102, and by which the support plunger 102 can be made to press against the coupling rod 50 supported at a certain pretensioning on the other, is rigidly connected to the car body underframe 55, respectively, the housing of car body underframe 55, by an attachment 105.

Arranging energy-absorbing devices in or on the underframe of rail vehicles is generally known in the field of rail vehicle technology. Normally employed as the primary stage, is a reversibly-designed energy-absorbing device, integrated in the form of a spring element in the coupling shaft, for example, and which is to cushion impact forces occurring during operating, maneuvering and coupling. It is also possible—as depicted in FIG. 7—to provide an appropriate drawgear in the bearing block of the articulation, for example, in the form of elastomer spring elements, by which the coupling rod is fixed to the underframe of the car body. These elastomer spring elements provided in the articulation cushion tractive and compressive forces within a defined limit and route forces in excess of same uncushioned to the vehicle underframe via the bearing block.

While this type of primary energy-absorbing device, designed, for example, as a reversible energy-absorbing device, at least partly cushions or absorbs those tractive and impact forces which occur between the individual car bodies of a multi-member vehicle during normal vehicle operation, when the working load of the primary energy-absorbing device is exceeded, for example, should the vehicle collide with an obstacle, the damping capacity provided by the primary stage is usually no longer sufficient to effectively prevent excessive impact force from being transmitted to the vehicle underframe. In such a case, the vehicle underframe is subjected to extreme loads such that the risk is run of the car body being damaged or derailing. The working load of the primary energy-absorbing device, also designated as the damping capacity provided by the primary stage, normally corresponds to the working load of the coupling itself.

One approach to preventing an uncushioned routing of impact forces to the vehicle underframe upon the working load of the primary energy-absorbing device being exceeded provides for, in addition to the primary stage, for example, in the form of elastomer spring elements in the articulation of the coupler shaft, a further (secondary) energy-absorbing device, for example, in the form of two side buffers at the outer edge of the front face of the respective car body. It is likewise known from rail vehicle technology to provide, additionally to or in place of side buffers as secondary energy-absorbing devices, at least one deformation tube downstream of the primary energy-absorbing device and which normally does not respond until after the working load of the primary energy-absorbing device, respectively coupling, is exceeded.

Regardless of its realization, the secondary energy-absorbing device serves to absorb or cushion the impact energy ensuing from excessive overrunning collisions. It is in principle also possible, after the primary energy-absorbing device has been exhausted, to deflect the remaining energy to energy-absorbing elements on the car body side, for example friction elements, by a predetermined breaking point in the coupler linkage.

The additional secondary energy-absorbing device provided, also called "overload protection," thereby serves as an additional shock absorber to protect the vehicle underframe from damages in the event of strong rear-end collisions. As mentioned above, this type of secondary energy-absorbing device can, for example, be realized as side buffers at the outer edge of the front face of the car body. So that the secondary energy-absorbing device can, for example, in the event of a crash; i.e., upon exceeding the working load of the central buffer coupling, respectively the primary energy-absorbing device provided in the central buffer coupling, respond in a defined manner and dissipate or dampen excessive impact energy according to a pre-defined sequence of events, it is necessary for the coupling to be removed from the transmitted flow of force. This usually occurs in such a way that the coupling rod together with the coupling head disposed at the coupling plane side end of the coupling rod and the articulation provided at the car body side end of the coupling rod, are pushed backward toward the car body out of the coupling plane and thus, removed from the flow of force transmitted between two adjacent car bodies.

It is, for example, conceivable that after the energy absorption provided by the primary energy-absorbing device has been exhausted upon a critical impact force being exceeded, the articulation of the coupling rod, the bearing block respectively, shears off at predetermined breaking points and a substantial portion of the coupling is pushed into a space in the car body's underframe by a cross-member provided on the front face of the car body.

In the case of a central buffer coupling, on the other hand, which—as FIG. 7 depicts—exhibits a supporting device fixedly connected to the car body underframe for the vertical support of the coupling rod, in the event of a crash, the necessary longitudinal displacement of the coupling rod toward the car body is limited by the supporting device disposed on the car body underframe. Particularly in the case of couplings which exhibit relatively large displacement in the event of a crash, the supporting device fixedly connected to the car body underframe prevents the coupling rod and the coupling head disposed at the coupling plane side end of the coupling rod from being removed from the flow of force transmitted between two adjacent car bodies in a defined manner, such that neither is a defined response of a conceivably provided secondary energy-absorbing device possible, and energy cannot be absorbed in the conceivably provided secondary energy-absorbing device according to a predetermined sequence of events.

SUMMARY OF THE INVENTION

Based on this problem, the task addressed by the present invention is that of specifying a device to vertically support a coupling rod of a central buffer coupling pivotally articulated vertically to a car body underframe, wherein the supporting device does not obstruct the displacement of the coupling toward the car body in the event of a crash.

The underlying task of the invention is solved by a supporting device which includes a support able to be brought into contact with the coupling rod of a central buffer coupling and a mount connected to the support and affixed to the vehicle underframe. In accordance with the invention, it is thereby provided for the mount to include a connecting element by which the support is connected to the mount. The connecting element defines a rotational axis about which the support can rotate relative to the connecting element. At least one shearing element is furthermore, provided in the supporting device, according to the inventive solution, to connect the connecting element to the support, and which is designed to shear off upon the exceeding of a predetermined or definable amount of torque being transmitted from the support to the connecting element via the at least one shearing element, in order to allow a rotation of the support relative to the connecting element.

The advantages attainable with the present invention are obvious. By providing a connecting element which defines a rotational axis, about which the support can rotate relative the connecting element, it is possible when needed, and in particular in the event of a crash or after the working load of the coupling has been exceeded, for the support to rotate via the rotational axis defined by the connecting element into a position in which the support no longer interferes with the movement of the central buffer coupling toward the car body. Specifically, at least one shearing element is provided in accordance with the invention for connecting the connecting element and the support, and is designed so as to shear off upon exceeding of a predetermined or definable amount of torque transmitted from the support to the connecting element via the at least one shearing element and thus, allow the support to rotate about the rotational axis defined by the connecting element relative said connecting element.

To understand the term "shearing element" as used herein, is any component which serves as a force-transferring member to transmit force or torque between the support and the mount up to a maximum-acting shear stress on the component, and shears off upon or after the maximum shear stress is exceeded, and thus, loses its capacity to transfer force on the one hand, and, on the other, its function of jointly connecting the connecting element and the support. It is thus, preferred for the shearing strength of the at least one shearing element to be predefined such that the shearing off of the at least one shearing element will not occur until a predefined critical torque is transmitted from the support to the connecting element via the at least one shearing element. Critical torque occurs, for example, when the coupling head disposed at the coupling plane side end of the coupling rod strikes against the support of the supporting device upon the longitudinal displacement of the central buffer coupling toward the car body during a crash.

As mentioned above, due to its construction, the at least one shearing element primarily transfers torque and virtually no vertical forces. To connect the connecting element to the support, the at least one shearing element is hereto preferably integrated into the supporting device such that it is situated in a line extending radially from the rotational axis defined by the connecting element. This measure effectively eliminates malfunction of the at least one shearing element upon a vertical overload of the supporting device which can occur, for example, when the coupling rod strikes the support of the supporting device or an increased vertical force is otherwise conveyed to the support of the supporting device.

Because a rotation of the support relative the connecting element is allowed upon the actuation of the at least one shearing element, the supporting device can be pivoted downward away from the coupling rod so that there will be no components in the way to interfere with the coupling displacing longitudinally toward the car body. The supporting device pivoted out of the coupling's path of displacement still remains fixedly connected to the car body underframe by the mount for the supporting device so as to also keep free of the track bed and so that no components of the supporting device will drop away.

Because the at least one shearing element is accorded no holding function whatsoever according to the inventive solution, it is possible to configure a relatively low critical shearing force at which the at least one shearing element shears off and enables the support to rotate out of the coupling's path of displacement. Accordingly, a lower and in particular precisely foreseeable critical shearing force can be set upon which a rotation of the support relative the connecting element occurs.

A torque is utilized in the supporting device according to the invention in order to exert shearing forces on the at least one shearing element. This represents an easily obtainable yet effective option of realizing a controlled and defined shearing off of the at least one shearing element upon overload. By suitably selecting the material and the dimensions to the at least one shearing element, such a controlled shearing off is possible, in particular, even at lower actuating forces or torques. This is particularly necessary for supporting devices serving to vertically support the coupling rod of an AAR coupling, since in these types of AAR couplings, the coupling head lock is provided at the rear side end of the coupling head. Reference numeral "57" identifies the lock of the AAR coupling in FIG. 7.

Were it to take relatively high actuating forces before the supporting device could pivot away in such a coupling, in which the coupling lock is at the rear side end of the coupling head, this would run the risk that the coupling lock might release upon striking the supporting device during the longitudinal displacement of the coupling toward the car body, a consequence of which might be the unintended separating of the coupling heads of two adjacent coupled car bodies.

The at least one shearing element is preferably configured such that upon a transmission of forces, and in particular a transmission of dynamic forces between the support and the mount, the at least one shearing element primarily transmits only shearing forces. It is hereby conceivable in one embodiment according to the invention, for at least one shearing element to be configured as a replaceable safety bolt or shear pin so that a simple replacement of the shearing element or elements of a supporting device pivoted out of the coupling's path of displacement, for example in the event of a crash, puts same back in operation again.

One embodiment of the supporting device according to the invention provides for the same to serve in elastically supporting a coupling rod. It is hereby conceivable for the support to include a support plunger able to be brought into contact with the coupling rod and a support body connected to the support plunger, wherein the support body is connected to the connecting element such that after the shearing off of the at least one shearing element, the support body with the support plunger can rotate about the rotational axis defined by the connecting element. The support body and the support plunger should thereby, be movable relative one another. Preferably, for example, the support body includes at least one sleeve-shaped element, in which an elastic element, in particular a spring element, is provided, by which the support plunger is connected to the support body.

In a further embodiment of the latter elastic support, it is conceivable to provide a locking device with which the support plunger and the support body can be locked relative one another.

Alternatively or additionally hereto, it is further conceivable for the spring characteristic and in particular the spring hardness of the at least one elastic element to be adjustable, also subsequent its fitting into the supporting device.

With respect to the mount of the supporting device, it is preferable for the mount to include at least one bearing attachable to the car body underframe to which the connecting element can be fixed. This bearing can be configured as a fixed bearing, for example, by which the connecting element is fixed in all three degrees of translational freedom. Advantageously, the mount includes a total of two bearings serving to fix the connecting element, whereby one bearing is configured as a fixed bearing, by which the connecting element is fixed in all three degrees of translational freedom, and whereby the other bearing is configured as a loose bearing, by which the connecting element is fixed in two degrees of translational freedom so as to allow a relative movement in the longitudinal direction of the connecting element between the bearing configured as a loose bearing and the connecting element. Employing a fixed bearing on one side and a loose bearing on the other provides a connection as the mount which allows supporting devices of existing vehicles to be retrofitted since the mount can be flexibly fixed to car body underframes appropriately.

The connecting element is for example, configured as an elongated pin, whereby the rotational axis about which the support rotates relative the connecting element after the shearing off of the at least one shearing element is defined by the longitudinal direction of the pin. It is specifically conceivable to configure the connecting element as a rotationally symmetrical pin, its symmetrical axis defining the rotational axis about which the support rotates relative the connecting element after the shearing off of the at least one shearing element. This rotationally symmetrical pin should preferably be secured by the above-cited fixed bearing on one side, and by the loose bearing on the other.

BRIEF DESCRIPTION OF THE DRAWINGS

Reference will be made in the following to FIGS. 1 to 6 of the accompanying drawings in describing an example of various embodiments of the supporting device according to the invention.

The accompanying drawings show.

DETAILED DESCRIPTION OF THE INVENTION

Figure 1:
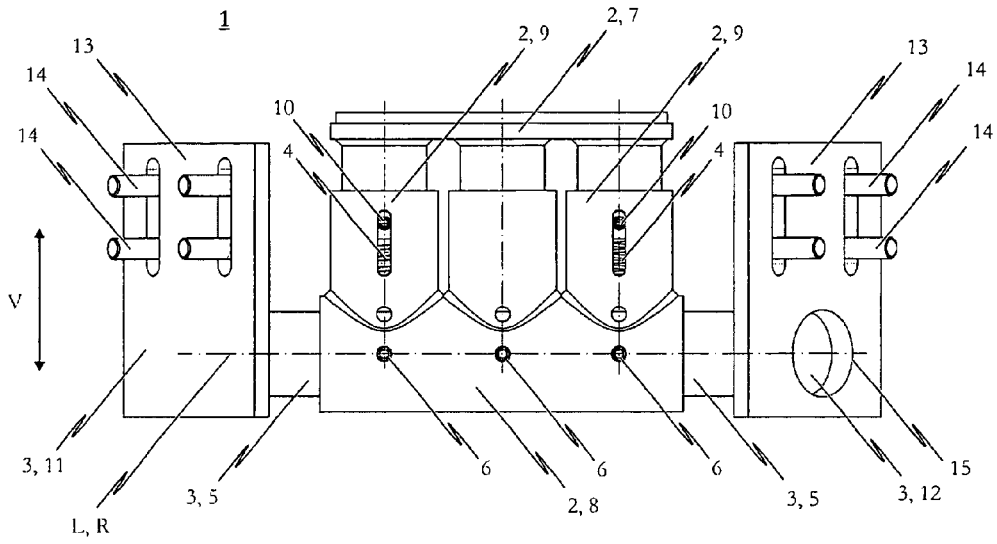
FIG. 1: one embodiment of the supporting device according to the invention in a schematic view of the supporting device side facing the car body.
Figure 2:
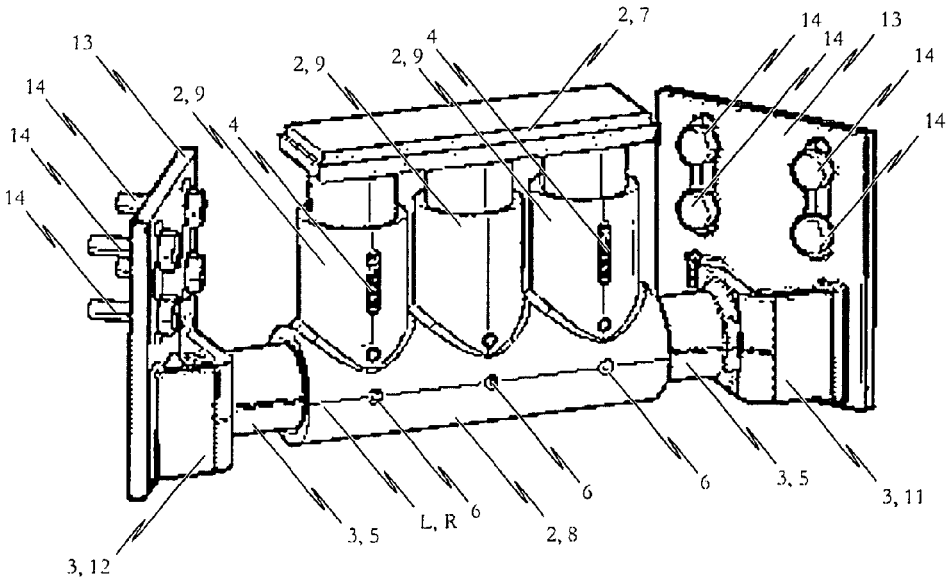
FIG. 2: a three-dimensional perspective depiction of the supporting device in accordance with one embodiment in a view of the supporting device side facing the coupling plane.
Figure 3:
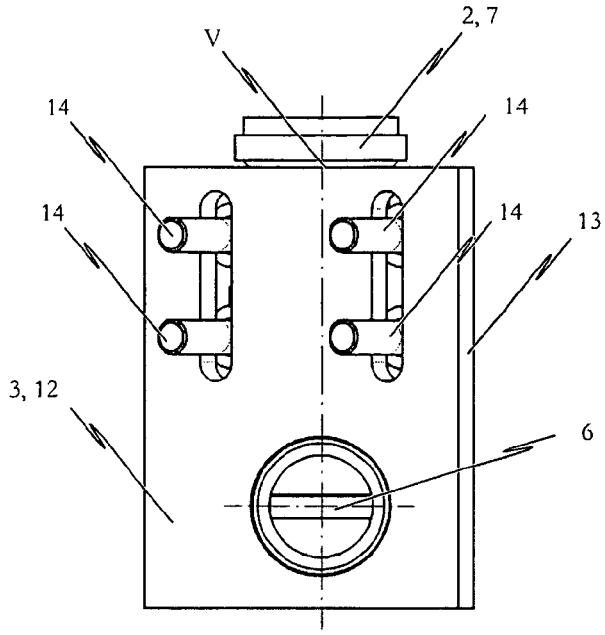
FIG. 3: a schematic side view of the supporting device in accordance with one embodiment of the invention.
Figure 4:
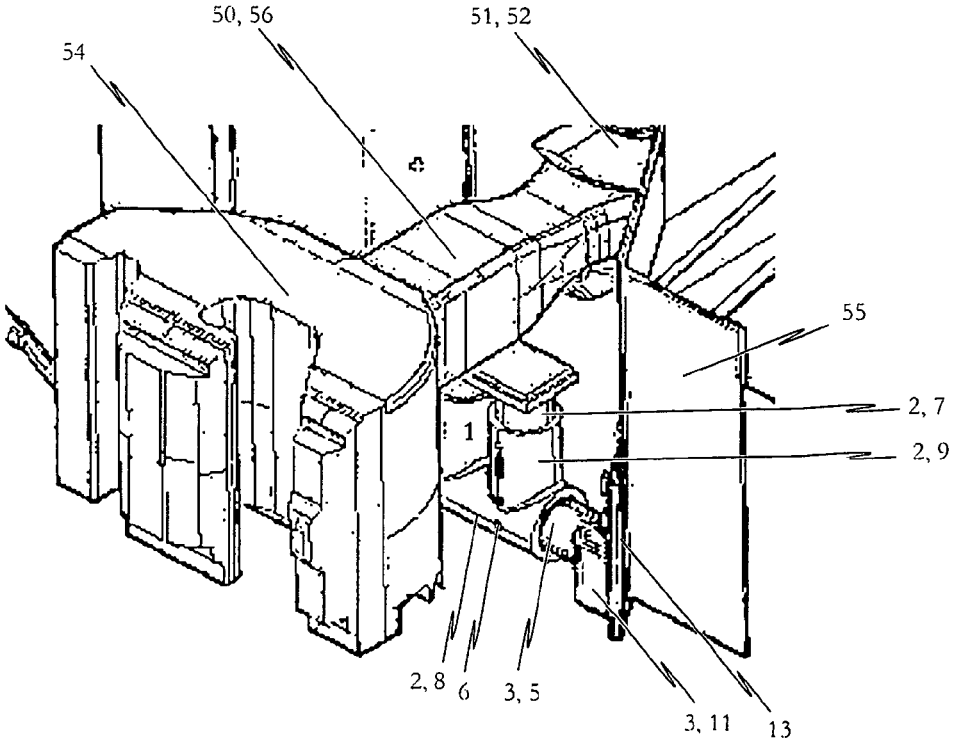
FIG. 4: the supporting device in accordance with one embodiment of the invention in the installed and operative state.

FIG. 1 shows a schematic representation of one embodiment of the supporting device 1 in accordance with the invention in a view of the side of the supporting device 1 facing the car body in the installed state. The representation according to FIG. 2 shows one embodiment of the supporting device 1 in accordance with the invention in a perspective view, that being of the side of supporting device 1 which faces the coupling plane in the installed state of supporting device 1. FIG. 3 shows one embodiment of the supporting device 1 in a schematic representation of a view of one side of same. FIG. 4 shows the supporting device in accordance with one embodiment in the installed and operative state.

The supporting device 1 as depicted includes a support 2 as well as a mount 3 connected to said support 2, which—as FIG. 4 depicts—can be affixed to a car body underframe 55 of a vehicle, in particular a rail vehicle. The mount 3 includes a connecting element 5 configured as a rotationally symmetrical pin in the depicted embodiment of supporting device 1. The support 2 is connected to the mount 3 by the connecting element 5 configured as a rotationally symmetrical pin.

Specifically, and as can in particular be seen from the representation shown in FIG. 2, the mount 3 includes a total of two bearings 11, 12 which, as evidenced by the representation according to FIG. 4, can be fixed by use of bolts 14 to the car body underframe 55 of the vehicle not explicitly shown in the drawings. The connecting element 5 is fixed at both bearings 11, 12.

In one embodiment of the inventive supporting device 1, the bearing 11 provided on the right-hand side of the connecting element 5 in FIG. 2 is configured as a fixed bearing, by which the connecting element 5 in fixed in all three degrees of translational freedom.

The connecting element 5 employed in the depicted embodiment of the supporting device 1 is—as mentioned above—configured as an elongated and rotationally symmetrical pin, whereby one end of the connecting element 5 is fixed to the fixed bearing 11 and the other end of the connecting element 5 to a second bearing 12 arranged in FIG. 2 on the left-hand side of the connecting element 5. The further bearing 12 arranged in FIG. 2 on the left side is preferably configured as a loose bearing, by which the connecting element 5 is only fixed in two degrees of translational freedom such that movement is granted in the direction of the symmetrical axis of connecting element 5.

To realize the bearing 12 configured as a loose bearing, an opening 15 is provided in a flange 13 in the supporting device 1 depicted in the drawings, through which the connecting element 5 can run in the direction of the symmetrical axis L of connecting element 5. The opening 15 configured in flange 13 is in particular visible in the FIG. 1 representation.

The support 2 includes a support plunger 7 and a support body 8 in the embodiment depicted of the inventive supporting device 1, whereby the support plunger 7 is at least partly accommodated in sleeve-shaped elements 9 of the support body 8. Elastic elements 4 in the form of spring elements are moreover provided which likewise are accommodated in the sleeve-shaped elements 9 of the support body 8 and elastically distance the support plunger 7 from the support body 8.

The resilient effect of the elastic spring elements 4 accommodated in the sleeve-shaped elements 9 of the support body 8 can be activated or deactivated as need be, by a locking device 10, for example, in the form of an engaging locking bolt. The appropriate bolts can be provided hereto for activating the locking device 10.

It is of course also conceivable to realize the locking device 10 to lock the support plunger 7 and the support body 8 relative to one another in a different manner. It is likewise conceivable as need be to set the spring characteristic, damping characteristic respectively, of the elastic spring element 4 also after the elastic spring element 4 is fitted into the supporting device 1.

The support 2 includes the support plunger 7 and the support body 8, wherein the support body 8 includes the above-cited sleeve-shaped elements 9 for receiving the elastic spring elements 4 on the one hand and partially receiving the support plunger 7 on the other. This embodiment of the supporting device 1 according to the invention thereby provides for the connecting element 5 to be configured as an elongated, rotationally symmetrical pin to run through the support body 8 of support 2 and be accordingly routed in the support body 8. The support body 8 and the connecting element 5 are thereby connected together such that the support body 8 together with the support plunger 7 can rotate about a rotational axis R relative the connecting element 5. Rotational axis R is defined by connecting element 5, and in particular by the symmetrical axis L of the connecting element 5 configured as a rotationally symmetrical pin in the preferred realization of the inventive supporting device 1 as depicted.

As can in particular be noted from the representations shown in FIGS. 1 and 2, the embodiment of the inventive supporting device 1 includes shearing elements 6 which serve to tensionally connect the support 2 and in particular, the support body 8 of support 2 to connecting element 5.

In the depicted embodiment of the inventive supporting device 1, the shearing elements 6 are preferably configured as replaceable safety bolts or shear pins which connect the support 2 and in particular, the support body 8 of support 2 with connecting element 5, routed through the support body 8, and thus, fix the connecting element 5 to support 2.

Because the support 2, respectively the support body 8 with support plunger 7, is rotationally mounted about the rotational axis R defined by the connecting element 5 in the supporting device 1 according to the invention, upon a transmission of forces, and in particular a transmission of dynamic forces between the support 2 and the mount 3, primarily only shearing forces resulting from the torque act on the shearing elements 6.

Specifically, the shearing elements 6 are designed so as to shear off upon a predetermined or definable amount of torque transmitted from the support 2 to the connecting element 5 via said shearing elements 6 being exceeded, whereby a rotation of the support 2, respectively the support body 8 together with support plunger 7, relative to the connecting element 5 is allowed about the rotational axis R defined by the symmetrical axis L of connecting element 5.

Figure 5:
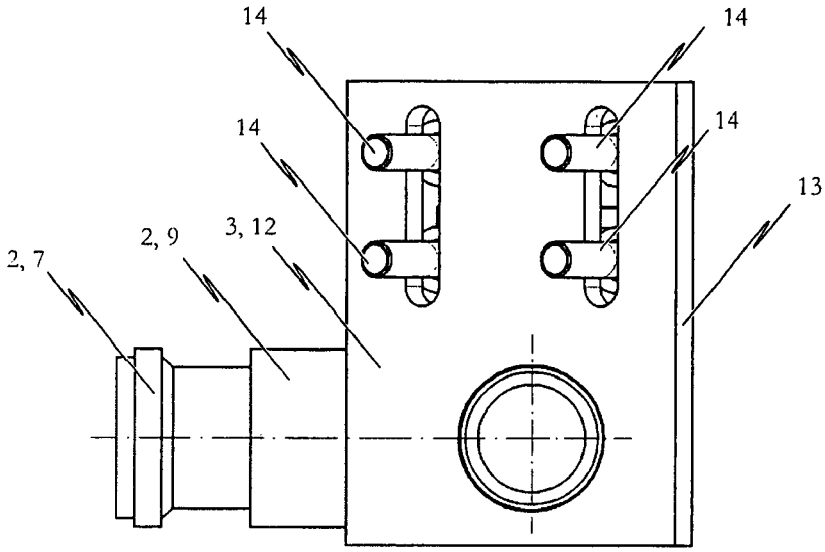
FIG. 5: a schematic side view of the supporting device in accordance with one embodiment of the invention subsequent of the shearing off of the at least one shearing element and subsequent the pivoting of the support about the rotational axis defined by the connecting element.

FIG. 5 shows one embodiment of the supporting device 1 in a state after response of the shearing elements 6 and a rotation of support 2 relative the connecting element 5. The depiction in accordance with FIG. 6 shows a perspective partly sectional view of the embodiment of the supporting device 1 after the shearing elements 6 have been sheared off and the support 2 pivoted out of the path of longitudinal displacement of the central buffer coupling 56.

Figure 6:
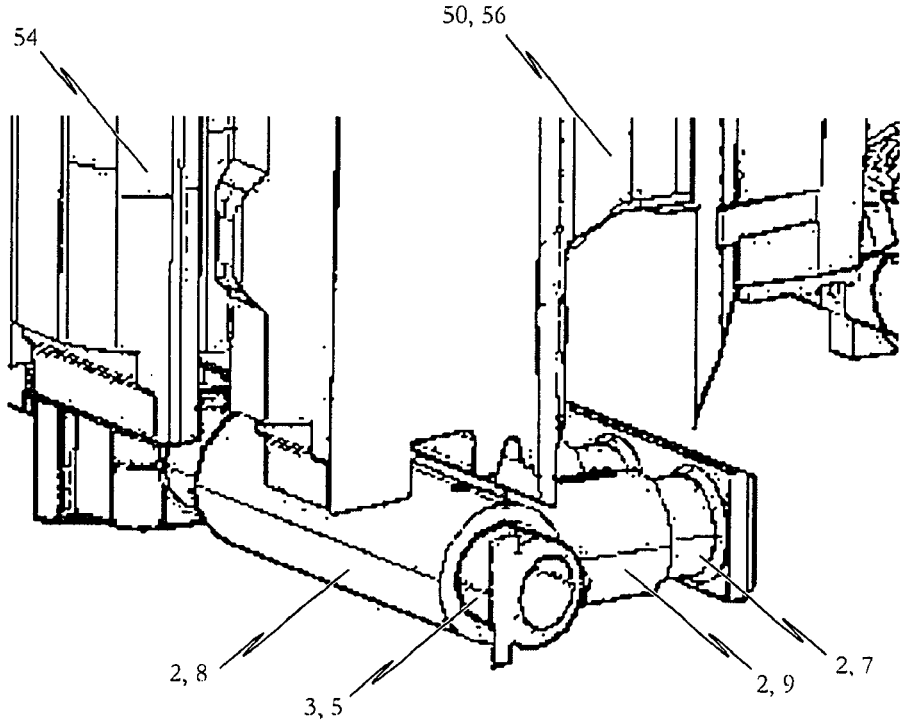
FIG. 6: the supporting device in accordance with one embodiment of the invention in the installed stated subsequent the actuation of the at least one shearing element and subsequent the pivoting of the support about the rotational axis defined by the connecting element.

On the basis of the representations according to FIGS. 5 and 6, it is evident that after the shearing elements 6 are sheared off, the support 2 of the supporting device 1 is pivotable relative to the connecting element 5 of the mount 3 about the rotational axis R defined by connecting element 5.

Accordingly, the inventive supporting device 1 is particularly suited to vertically support a central buffer coupling 56, a coupling rod 50 of a central buffer coupling 56 respectively, when the central buffer coupling 56 needs to be removed from the coupling plane, for example in the event of a crash, in order to ensure energy absorption by a secondary energy-absorbing device (not explicitly shown in the drawings).

Figure 7:
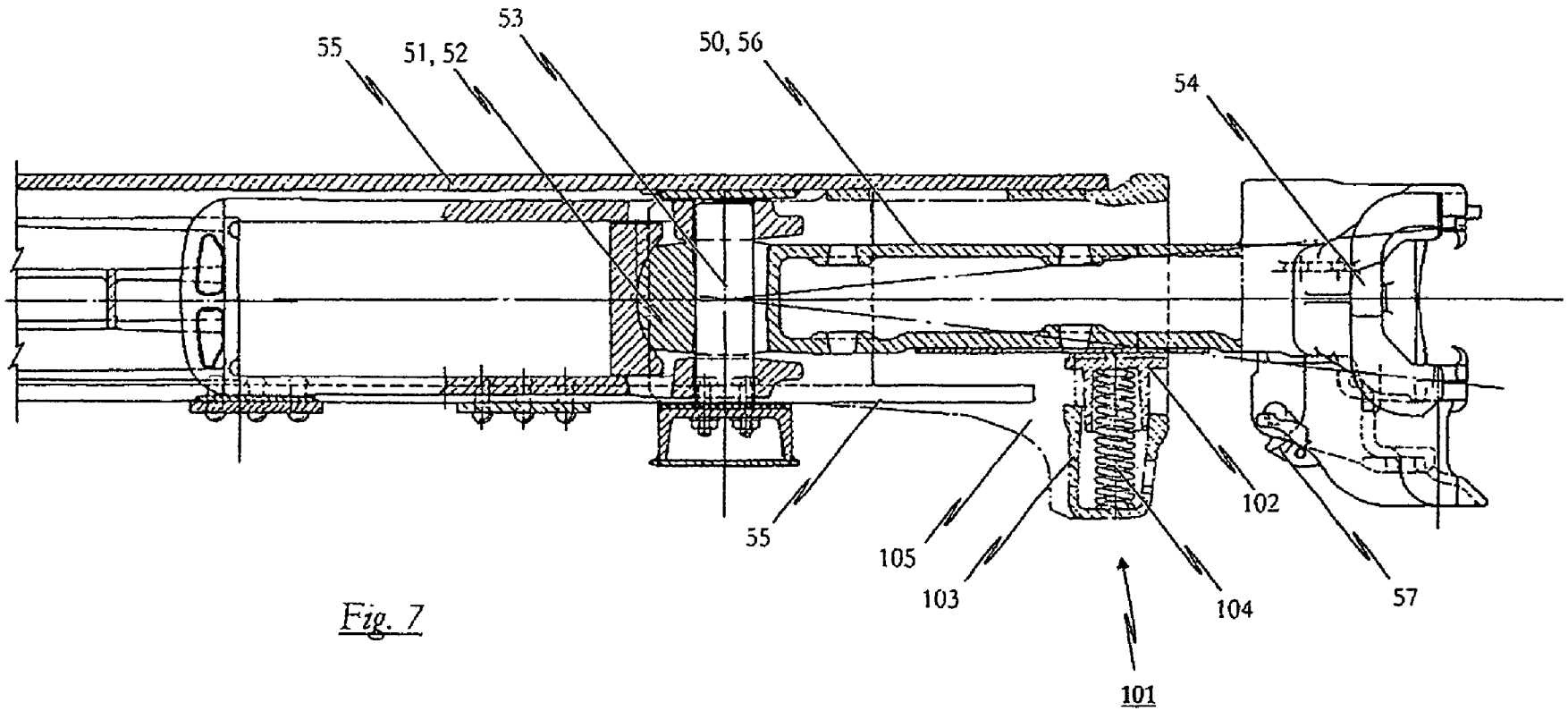
FIG. 7: a schematic side sectional view of an AAR central buffer coupling of the F standard having a conventional supporting device.

As already described with reference to FIG. 7, this type of secondary energy-absorbing device can be configured as side buffers, for example.

A comparison of the representations according to FIG. 4 and FIG. 6 shows that the inventive supporting device 1 in normal vehicle operation (cf. FIG. 4) serves to vertically support the coupling rod 50 of the central buffer coupling 56 in a resilient or elastic manner. In normal vehicle operation, the tractive/compressive forces transmitted from the coupling rod 50, for example by the elastomer bearing accommodated in bearing block 51, and in particular, by the elastomer spring elements 52, are at least partly absorbed and dampened. After the working load of the central buffer coupling 56 has been exceeded, however; i.e., after the maximum possible energy absorption, respectively the maximum possible damping of the impact force by the elastomer spring elements 52 in the elastomer bearing has been exhausted, the central buffer coupling 56 is to be removed from the flow of forces transmitted between two adjacent car bodies in order to enable actuation of secondary energy-absorbing devices (for example in the form of side buffers). The central buffer coupling 56 is thereby, normally taken out of the flow of force transmitted between two adjacent car bodies by a longitudinal displacement of said central buffer coupling 56 toward the car body ensuing subsequent the working load of the central buffer coupling 56 being exceeded.

During a crash, i.e., when the central buffer coupling 56 is moved toward the car body, in order to thus, be able to be taken out of the flow of forces transmitted between two adjacent car bodies, the coupling head 54 of the central buffer coupling 56 necessarily impacts against the supporting device 1 with its movement in the direction of the car body and in particular against the support 2 of supporting device 1. Upon this event, the solution in accordance with the invention provides for the shearing elements 6, which connect the support 2 of supporting device 1 to the connecting element 5 of mount 3 of the supporting device 1 to shear off so as to enable the support 2 to be able to pivot out of the path of displacement of the central buffer coupling 56, respectively out of the path of displacement of the coupling head 54 of central buffer coupling 56.

Thus, the present invention offers an easily realized and yet effective solution for taking the supporting device 1 out of the path of displacement of the central buffer coupling 56 upon a crash without affecting the effectiveness of the vertical support of the coupling rod 50 of the central buffer coupling during normal vehicle operation.

The inventive supporting device 1 is likewise particularly suited to retrofitting existing central buffer couplings, since the supporting device 1 is connected to the car body underframe 55 of the railborne vehicle, and in particular the rail vehicle, via the mount 3, and specifically via the bearings 11, 12 of mount 3. As mentioned above, it is preferred for at least one of the bearings to be configured as a loose bearing so that car bodies of different designs can in this way be retrofitted with the supporting device 1 without needing to make major structural changes to the supporting device 1 or the car body underframe.

The invention is not limited to the embodiment example of the preferred realization of the supporting device shown in the drawings. The invention instead follows from the skilled and comprehensive consideration of the claims and the description of the embodiment example.

The invention claimed is:

1. A supporting device in combination with a rail-borne vehicle which comprises a central buffer coupling having a coupling rod pivotably articulated vertically to a car body underframe by a bearing block, the supporting device vertically supporting the coupling rod of the central buffer coupling, said supporting device comprising:

a support operative to be brought into contact with the coupling rod; and a mount connected to the support and fixable to the car body underframe of the vehicle, wherein the mount comprises a connecting element, by which the support is connected to the mount, wherein the connecting element defines a horizontal rotational axis about which the support is configured to rotate relative to the connecting element;

wherein at least one shearing element is provided which connects the connecting element to the support, and which is designed to shear off upon the exceeding of a predetermined or definable amount of torque being transmitted from the support to the connecting element via the at least one shearing element in order to allow a rotation of the support about the horizontal rotational axis relative to the connecting element; and wherein a coupling head is arranged on a coupling plane side end of said coupling rod, and wherein when the working load of the central buffer coupling is exceeded, the coupling rod and the coupling head are pushed together toward the rail-borne vehicle and the coupling head strikes against the support of the supporting device.

2. A supporting device to vertically support a coupling rod of a central buffer coupling pivotably articulated vertically to a car body underframe of a vehicle by a bearing block, wherein said supporting device comprises a support able to be brought into contact with the coupling rod and a mount connected to the support and fixable to the car body underframe of the vehicle, wherein the mount comprises a connecting element, by which the support is connected to the mount, wherein the connecting element defines a horizontal rotational axis about which the support is configured to rotate relative to the connecting element;

wherein at least one shearing element is provided which connects the connecting element to the support, and which is designed to shear off upon the exceeding of a predetermined or definable amount of torque being transmitted from the support to the connecting element via the at least one shearing element in order to allow a rotation of the support about the horizontal rotational axis relative to the connecting element;

wherein the support comprises a support plunger able to be brought into contact with the coupling rod and a support body connected to the support plunger, wherein the support body is connected to the connecting element such that after the shearing off of the at least one shearing element, the support body with the support plunger can rotate about the horizontal rotational axis defined by the connecting element, and wherein the support body and the support plunger are movable relative to one another; and wherein at least one elastic element is provided, by which the support plunger is connected to the support body.

3. The supporting device according to claim 2, wherein the support body comprises at least one sleeve-shaped element, in which said at least one elastic element and at least a portion of the support plunger is accommodated.

4. The supporting device according to claim 2, wherein the at least one elastic element comprises a spring element, and wherein a spring hardness of the spring element is adjustable subsequent its fitting into the supporting device.

5. The supporting device according to claim 2, wherein a locking device is provided to lock the support plunger and the support body relative one another.

6. The supporting device according to claim 2, wherein the connecting element runs through the support body and is conducted in said support body.

7. The supporting device according to claim 2, wherein the mount comprises at least one bearing attachable to the car body underframe to which the connecting element can be fixed.

8. The supporting device according to claim 7, wherein the at least one bearing is configured as a fixed bearing, by which the connecting element is fixed in all three degrees of translational freedom.

9. The supporting device according to claim 7, wherein the mount comprises a bearing attachable to the car body underframe and configured as a fixed bearing, by which the connecting element is fixed in all three degrees of translational freedom; and wherein the mount comprises a bearing attachable to the car body underframe and configured as a loose bearing, by which the connecting element is fixed in two degrees of translational freedom so as to allow a relative movement in a longitudinal direction of the connecting element between the bearing configured as a loose bearing and said connecting element.

10. The supporting device according to claim 7, wherein the at least one bearing comprises a flange or a flange-shaped plate, by which the mount is detachably connected to the car body underframe with bolts.

11. The supporting device according to claim 2, wherein the connecting element comprises an elongated pin, wherein the horizontal rotational axis about which the support rotates relative the connecting element subsequent the shearing off of the at least one shearing element is defined by a longitudinal direction of the elongated pin.

12. The supporting device according to claim 2, wherein the connecting element comprises a rotationally symmetrical pin, the symmetrical axis of which defines the horizontal rotational axis about which the support rotates relative to the connecting element subsequent the shearing off of the at least one shearing element.

13. A supporting device to vertically support a coupling rod of a central buffer coupling pivotably articulated vertically to a car body underframe of a vehicle by a bearing block, wherein said supporting device comprises a support able to be brought into contact with the coupling rod and a mount connected to the support and fixable to the car body underframe of the vehicle, wherein the mount comprises a connecting element, by which the support is connected to the mount, wherein the connecting element defines a horizontal rotational axis about which the support is configured to rotate relative to the connecting element;

wherein at least one shearing element is provided which connects the connecting element to the support, and which is designed to shear off upon the exceeding of a predetermined or definable amount of torque being transmitted from the support to the connecting element via the at least one shearing element in order to allow a rotation of the support about the horizontal rotational axis relative to the connecting element;

wherein the at least one shearing element connects the support to the mount such that upon a transmission of forces between the support and the mount, the at least one shearing element essentially transmits only shearing forces;

wherein the support comprises a support plunger able to be brought into contact with the coupling rod and a support body connected to the support plunger, wherein the support body is connected to the connecting element such that after the shearing off of the at least one shearing element, the support body with the support plunger can rotate about the horizontal rotational axis defined by the connecting element, and wherein the support body and the support plunger are movable relative to one another; and wherein at least one elastic element is provided, by which the support plunger is connected to the support body.

14. The supporting device according to claim 13, wherein the support body comprises at least one sleeve-shaped element, in which said at least one elastic element and at least a portion of the supporting plunger is accommodated.

15. The supporting device according to claim 13, wherein the at least one shearing element comprises at least one of a replaceable safety bolt or a shear pin.

16. The supporting device according to claim 13, wherein the mount comprises at least one bearing attachable to the car body underframe to which the connecting element can be fixed.

17. The supporting device according to claim 16, wherein the at least one bearing is configured as a fixed bearing, by which the connecting element is fixed in all three degrees of translational freedom.

18. The supporting device according to claim 16, wherein the mount comprises a bearing attachable to the car body underframe and configured as a fixed bearing, by which the connecting element is fixed in all three degrees of translational freedom; and wherein the mount comprises a bearing attachable to the car body underframe and configured as a loose bearing, by which the connecting element is fixed in two degrees of translational freedom so as to allow a relative movement in a longitudinal direction of the connecting element between the bearing configured as a loose bearing and said connecting element.

19. The supporting device according to claim 16, wherein the at least one bearing comprises a flange or a flange-shaped plate, by which the mount is detachably connected to the car body underframe with bolts.

20. The supporting device according to claim 13, wherein the connecting element comprises an elongated pin, wherein the horizontal rotational axis about which the support rotates relative the connecting element subsequent the shearing off of the at least one shearing element is defined by a longitudinal direction of the elongated pin.

21. The supporting device according to claim 13, wherein the connecting element comprises a rotationally symmetrical pin, the symmetrical axis of which defines the horizontal rotational axis about which the support rotates relative to the connecting element subsequent the shearing off of the at least one shearing element.

22. A supporting device to vertically support a coupling rod of a central buffer coupling pivotably articulated vertically to a car body underframe of a vehicle by a bearing block, wherein said supporting device comprises a support able to be brought into contact with the coupling rod and a mount connected to the support and fixable to the car body underframe of the vehicle, wherein the mount comprises a connecting element, by which the support is connected to the mount, wherein the connecting element defines a horizontal rotational axis about which the support is configured to rotate relative to the connecting element;

wherein at least one shearing element is provided which connects the connecting element to the support, and which is designed to shear off upon the exceeding of a predetermined or definable amount of torque being transmitted from the support to the connecting element via the at least one shearing element in order to allow a rotation of the support about the horizontal rotational axis relative to the connecting element;

wherein the at least one shearing element comprises at least one of a replaceable safety bolt or a shear pin;

wherein the support comprises a support plunger able to be brought into contact with the coupling rod and a support body connected to the support plunger, wherein the support body is connected to the connecting element such that after the shearing off of the at least one shearing element, the support body with the support plunger can rotate about the horizontal rotational axis defined by the connecting element, and wherein the support body and the support plunger are movable relative to one another; and wherein at least one elastic element is provided, by which the support plunger is connected to the support body.

23. The supporting device according to claim 22, wherein the support body comprises at least one sleeve-shaped element, in which said at least one elastic element and at least a portion of the supporting plunger is accommodated.

24. The supporting device according to claim 22, wherein the mount comprises at least one bearing attachable to the car body underframe to which the connecting element can be fixed.

25. The supporting device according to claim 24, wherein the at least one bearing is configured as a fixed bearing, by which the connecting element is fixed in all three degrees of translational freedom.

26. The supporting device according to claim 24, wherein the mount comprises a bearing attachable to the car body underframe and configured as a fixed bearing, by which the connecting element is fixed in all three degrees of translational freedom; and wherein the mount comprises a bearing attachable to the car body underframe and configured as a loose bearing, by which the connecting element is fixed in two degrees of translational freedom so as to allow a relative movement in a longitudinal direction of the connecting element between the bearing configured as a loose bearing and said connecting element.

27. The supporting device according to claim 24, wherein the at least one bearing comprises a flange or a flange-shaped plate, by which the mount is detachably connected to the car body underframe with bolts.

28. The supporting device according to claim 22, wherein the connecting element comprises an elongated pin, wherein the horizontal rotational axis about which the support rotates relative the connecting element subsequent the shearing off of the at least one shearing element is defined by a longitudinal direction of the elongated pin.

29. The supporting device according to claim 22, wherein the connecting element comprises a rotationally symmetrical pin, the symmetrical axis of which defines the horizontal rotational axis about which the support rotates relative to the connecting element subsequent the shearing off of the at least one shearing element.

* * * * *